US006000302A

United States Patent [19]

Chiang

[11] Patent Number: 6,000,302

[45] Date of Patent: Dec. 14, 1999

[54] TOOL HAVING ROTATABLE DRIVING HEAD

[76] Inventor: Der Ching Chiang, P.O. Box 63-99, Taichung, Taiwan

[21] Appl. No.: 09/057,215

[22] Filed: Apr. 7, 1998

[51] Int. Cl.[6] ..... B25B 23/16

[52] U.S. Cl. ..... 81/177.8; 81/177.7; 81/177.9

[58] Field of Search ..... 81/177.8, 177.7, 81/177.9

[56] References Cited

U.S. PATENT DOCUMENTS 4,463,632 8/1984 Parke ..... 81/177.9
4,711,145 12/1987 Inoue ..... 81/177.8
4,901,608 2/1990 Shieh ..... 81/177.8
5,199,335 4/1993 Arnold et al. ..... 81/177.7

*Primary Examiner*—Timothy V. Eley
*Assistant Examiner*—Sinclair Skinner

[57] ABSTRACT

A tool includes a driving head rotatably secured to one end of a handle which has an orifice and an aperture intersected with each other. A pawl has a rod slidably engaged with the orifice and has a tooth for engaging with the driving head. A spring may bias and move the rod to slide along the orifice and to force the tooth of the pawl to engage with the driving head and for selectively securing the driving head to the handle at any selected angular position. The tool includes few parts and elements which may be easily and quickly assembled.

3 Claims, 2 Drawing Sheets

TOOL HAVING ROTATABLE DRIVING HEAD

BACKGROUND OF THE INVENTION

1. Field of the Invention

The present invention relates to a tool, and more particularly to a tool having a rotatable driving head.

2. Description of the Prior Art

A typical wrench is disclosed in U.S. Pat. No. 4,901,608 to Shieh and comprise a driving head rotatably secured to a handle. The handle includes a gear and a pinion of different sizes slidably engaged in the handle for selectively engaging with the teeth of the driving head and for controlling the rotational movement of the driving head. However, the gear and the pinion may not be completely engaged with and completely disengaged from the teeth of the driving head such that the rotational movement of the driving head may not be easily operated. In addition, a number of parts and elements are required and may not be easily assembled.

The present invention has arisen to mitigate and/or obviate the afore-described disadvantages of the conventional wrenches.

SUMMARY OF THE INVENTION

The primary objective of the present invention is to provide a tool having a driving head that may be easily assembled in place and that may be effectively operated and actuated.

In accordance with one aspect of the invention, there is provided a tool comprising a handle including a first end having a pair of flanges for defining a notch between the flanges, the handle including a longitudinal orifice and a lateral aperture intersecting with the orifice, a driving head rotatably secured to the flanges of the handle at a pivot shaft, the driving head including a plurality of teeth engaged in the notch of the handle, a pawl including at least one tooth for engaging with the teeth of the driving head and including a rod extended downward from the pawl for slidably engaging with the orifice of the handle, and means for moving the rod of the pawl to slide along the orifice of the handle and to force the at least one tooth of the pawl to engage with the teeth of the driving head. The driving head is secured in a selected angular position relative to the handle when the at least one tooth of the pawl is forced to engage with the teeth of the driving head.

The moving means includes a button having a stem slidably engaged in the aperture of the handle, the rod of the pawl is engaged with the stem for preventing the stem of the button from being disengaged from the handle, and means for biasing the stem to engage with the rod of the pawl and to force the at least one tooth of the pawl to engage with the teeth of the driving head.

The stem of the button includes a tapered surface for engaging with the rod of the pawl and for moving the pawl toward the driving head by the biasing means, and the stem includes a recess for engaging with the rod, the teeth of the driving head are disengaged from the at least one tooth of the pawl when the rod of the pawl is engaged with the recess of the stem and when the button is depressed against the biasing means. The button includes a head, the handle includes a depression for slidably engaging with the head of the button.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
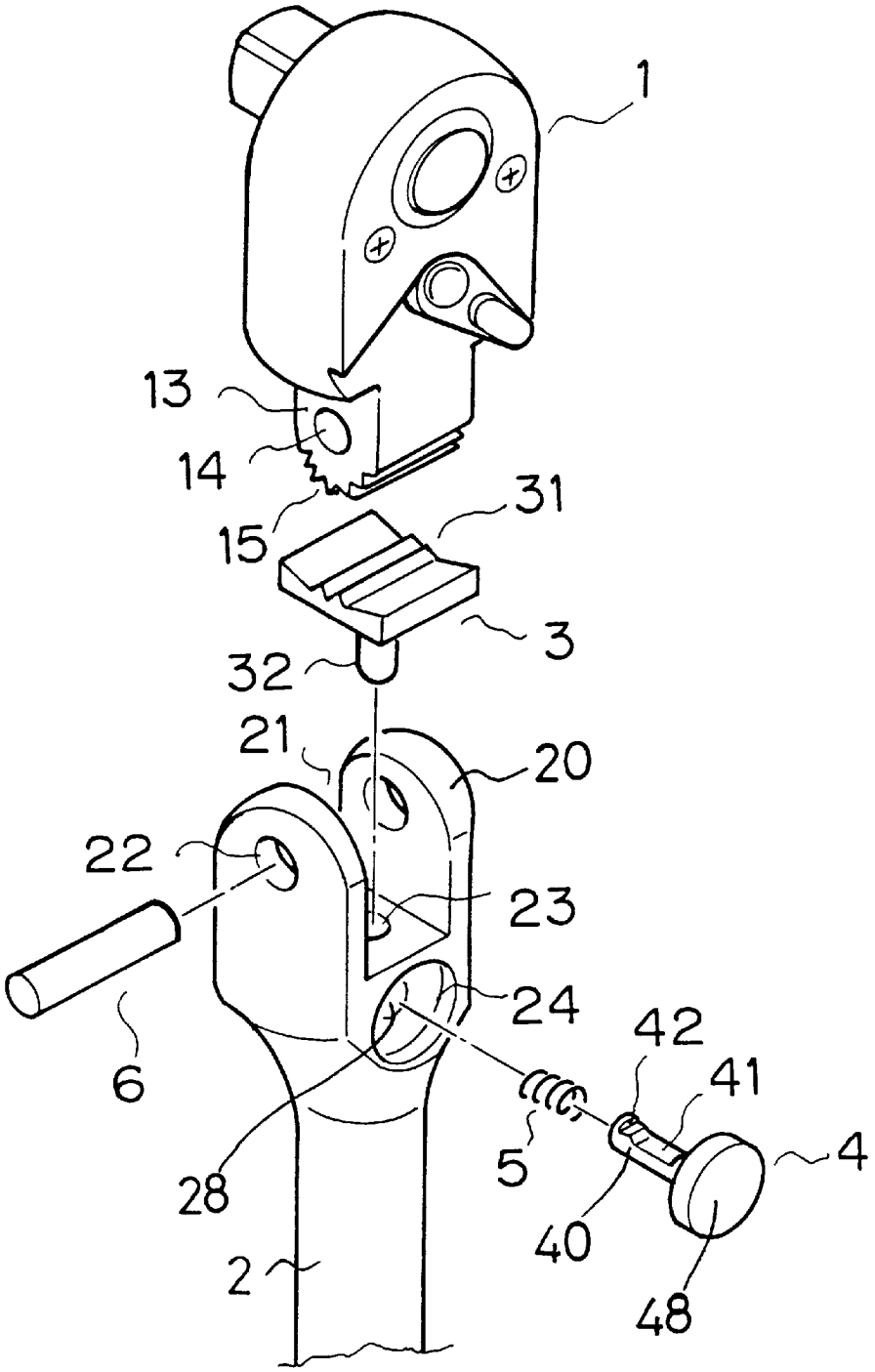
FIG. 1 is an exploded view of a tool in accordance with the present invention.
Figure 2:
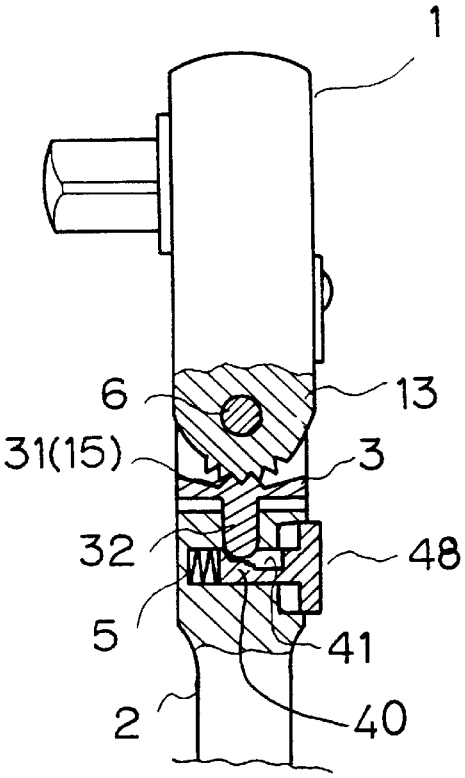
FIGS. 2 and 3 are partial cross sectional views illustrating the operation of the tool.

Referring to the drawings, and initially to FIGS. 1 and 2, a tool in accordance with the present invention may particularly be a wrench and comprises a handle 2 including a notch 21 formed in one end and defined between and by a pair of flanges 20. The flanges 20 each includes a hole 22 for engaging with a shaft 6 that extends through the notch 21. The handle 2 includes an orifice 23 extending along a longitudinal direction of the handle 2 and communicating with the notch 21, and includes an aperture 28 extending laterally and intersecting with the orifice 23 for slidably engaging with a button 4 and includes a depression 24. The button 4 includes a stem 40 slidably engaging in the aperture 28 and includes a head 48 for engaging with the depression 24 of the handle 2. The stem 40 includes a recess 41 and a tapered surface 42. A spring 5 is engaged in the aperture 28 for biasing the button 4 outward of the aperture 28.

Figure 3:
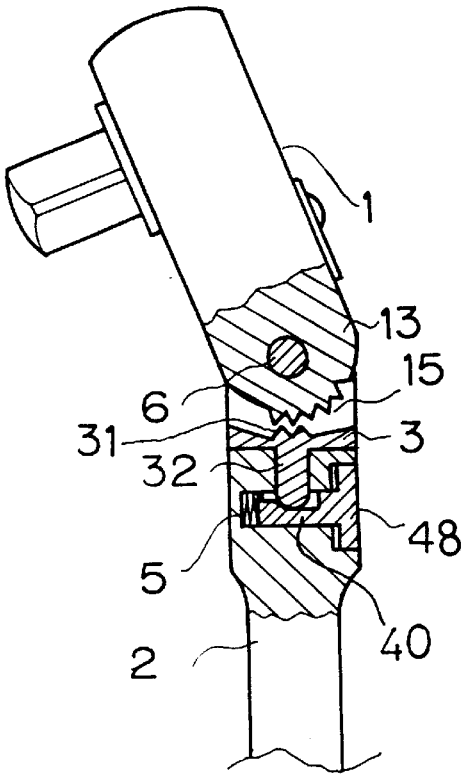

A driving head 1 includes an extension 13 engaged in the notch 21 of the handle 2 and having a puncture 14 for engaging with the shaft 6 and for allowing the driving head 1 to be rotated relative to the handle 2 about the shaft 6. The driving head 1 includes one or more teeth 15 provided in the bottom portion of the extension 13. A pawl 3 includes one or more teeth 31 provided on top for engaging with the teeth 15 of the driving head 1 and includes a rod 32 extended downward for slidably engaging with the orifice 23 and for engaging with the recess 41 and the tapered surface 41 of the stem 40 (FIGS. 2, 3).

In operation, as shown in FIG. 2, the spring 5 may bias the stem 40 outward of the aperture 28 for actuating the tapered surface 42 of the stem 40 to engage with and to move the teeth 31 of the pawl 3 to engage with the teeth 15 of the driving head 1, such that the driving head 1 may be positioned to the handle 2 at the selected angular position. It is to be noted that the rod 32 of the pawl 3 may engage with the tapered surface 42 of the stem 40 for preventing the button 4 from being disengaged from the handle 2 when the teeth 31 of the pawl 3 are engaged with that of the driving head 1. As shown in FIG. 3, when the button 4 is depressed inward of the aperture 28 against the spring 5, the rod 32 of the pawl 3 may engage with the recess 41 of the stem 40 such that the teeth 31 of the pawl 3 may be disengaged from the teeth 15 of the driving head 1 and such that the driving head 1 may be rotated to any selected or suitable angular position relative to the handle 2 before the teeth 31 of the pawl 3 are biased to engage with the teeth 15 of the driving head 15 by the spring 5 and the tapered surface 42 of the button 4 and before the button 4 is released.

It is further to be noted that the stem 40 may engage with the rod 32 of the pawl 3, and the pawl 3 may be retained in place by the driving head 1. When assembling the tool, the stem 40 of the button 4 may first be engaged into the aperture 28 of the handle 2 and the rod 32 of the pawl 3 may then be engaged into the orifice 3 for engaging with the stem 40 and for preventing the stem 40 from being disengaged from the handle 2. The driving head 1 is then engaged with the shaft 6 such that the pawl 3 may be retained in place by the driving head 1 and may be prevented from being disengaged from the handle 2. The button 4 may also be prevented from being disengaged from the handle 2 by the rod 32 of the pawl 3. Accordingly, the tool includes few parts which may be easily and quickly assembled in place.

Accordingly, the tool in accordance with the present invention includes a driving head that may be easily assembled in place and that may be effectively operated and actuated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a handle including a first end having a pair of flanges for defining a notch between said flanges, said handle including a longitudinal orifice and a lateral aperture intersecting with said orifice, a driving head rotatable secured to said flanges of said handle at a pivot shaft, said driving head including a Plurality of teeth engaged in said notch of said handle, a pawl including at least one tooth for engaging with said teeth of said driving head and including a rod extended downward from said pawl for slidably engaging with said orifice of said handle, and means for moving said rod of said pawl to slide along said orifice of said handle and to force said at least one tooth of said pawl to engage with said teeth of said driving head, said driving head being secured in a selected angular position relative to said handle when said at least one tooth of said pawl is forced to engage with said teeth of said driving head, said moving means including a button having a stem slidably engaged in said aperture of said handle, said rod of said pawl being engaged with said stem for preventing said stem of said button from being disengaged from said handle, and means for biasing said stem to engage with said rod of said pawl and to force said at least one tooth of said pawl to engage with said teeth of said driving head.

2. The tool according to claim 1, wherein said stem of said button includes a tapered surface for engaging with said rod of said pawl and for moving said pawl toward said driving head by said biasing means, and said stem includes a recess for engaging with said rod, said teeth of said driving head are disengaged from said at least one tooth of said pawl when said rod of said pawl is engaged with said recess of said stem and when said button is depressed against said biasing means.

3. The tool according to claim 1, wherein said button includes a head, said handle includes a depression for slidably engaging with said head of said button.

* * * * *